United States Patent [19]

Aryamane

[11] 4,099,321

[45] * Jul. 11, 1978

[54] METHOD OF MAKING A MINIATURE PLUG-IN FUSE

[75] Inventor: Avinash P. Aryamane, Elk Grove, Ill.

[73] Assignee: Littelfuse, Inc., Des Plaines, Ill.

[ * ] Notice: The portion of the term of this patent subsequent to May 17, 1994, has been disclaimed.

[21] Appl. No.: 790,395

[22] Filed: Apr. 25, 1977

Related U.S. Application Data

[63] Continuation-in-part of Ser. No. 692,040, Jun. 2, 1976, Pat. No. 4,023,265, which is a continuation of Ser. No. 640,253, Dec. 12, 1975, abandoned.

[51] Int. Cl.[2] ..... H01H 69/02

[52] U.S. Cl. ..... 29/623; 29/417; 113/116 P; 113/119

[58] Field of Search ..... 29/DIG. 15, DIG. 26, 29/414, 417, 610 R, 623; 339/62, 147 P, 208; 337/198, 187, 201, 206, 255, 262, 263, 264, 293, 295, 297; 113/116 D, 116.1, 119

[56] References Cited

U.S. PATENT DOCUMENTS

| | | | |
|---|---|---|---|
| 1,777,916 | 10/1930 | Glössl | 29/623 X |
| 1,926,445 | 9/1933 | Klopfenstein | 337/264 |
| 2,908,887 | 10/1959 | Broske | 113/119 |
| 3,436,711 | 4/1969 | Borzoni | 337/198 |
| 3,669,054 | 6/1972 | Desso et al. | 113/119 |
| 3,775,723 | 11/1973 | Mamrick et al. | 337/297 X |
| 3,775,724 | 11/1973 | Mamrick et al. | 337/297 X |
| 4,023,265 | 5/1977 | Aryamane | 29/623 |

FOREIGN PATENT DOCUMENTS

| | | | |
|---|---|---|---|
| 1,237,325 | 6/1960 | France | 29/623 |
| 456,749 | 7/1968 | Switzerland | 29/623 |

*Primary Examiner*—Victor A. DiPalma
*Attorney, Agent, or Firm*—Wallenstein, Spangenberg, Hattis & Strampel

[57] ABSTRACT

A method for making a plug-in fuse assembly comprises the steps of providing a blank of fuse metal which is initially provided between opposite margins thereof with a continuous portion of reduced thickness, blanking the blank of fuse metal to form a pair of generally parallel laterally spaced confronting terminal blade portions which are interconnected by a transverse web, current carrying extensions of the terminal blade portions and an interconnecting fuse link portion formed by remaining sections of said portion of reduced thickness, inserting and anchoring an insulating body between said current carrying extensions of the blank with the pair of terminal blade portions of the blank, which are interconnected by the transverse web, extending outwardly from the insulating lid, and blanking the exposed transverse web interconnecting the terminal blade portions.

12 Claims, 12 Drawing Figures

FIG. 5
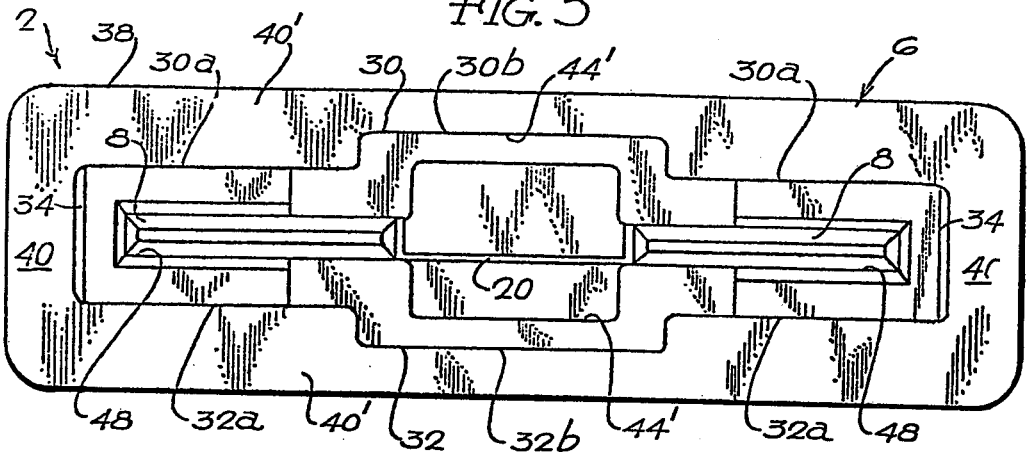
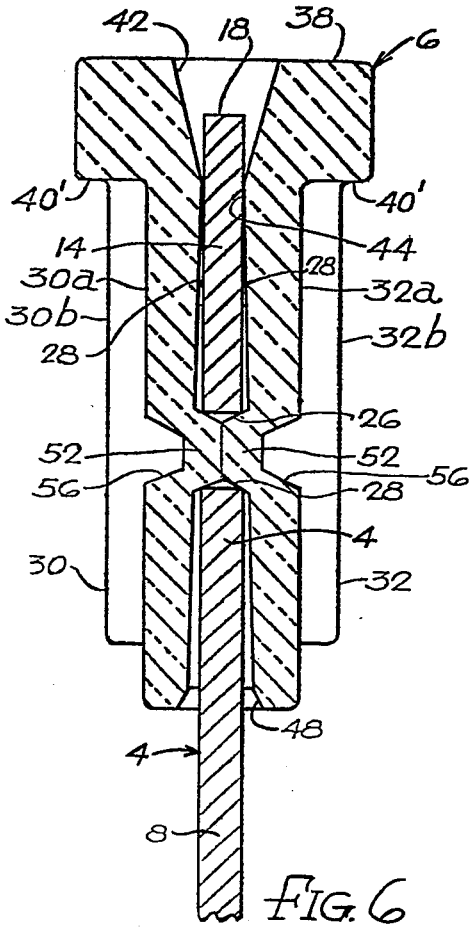
FIG. 6
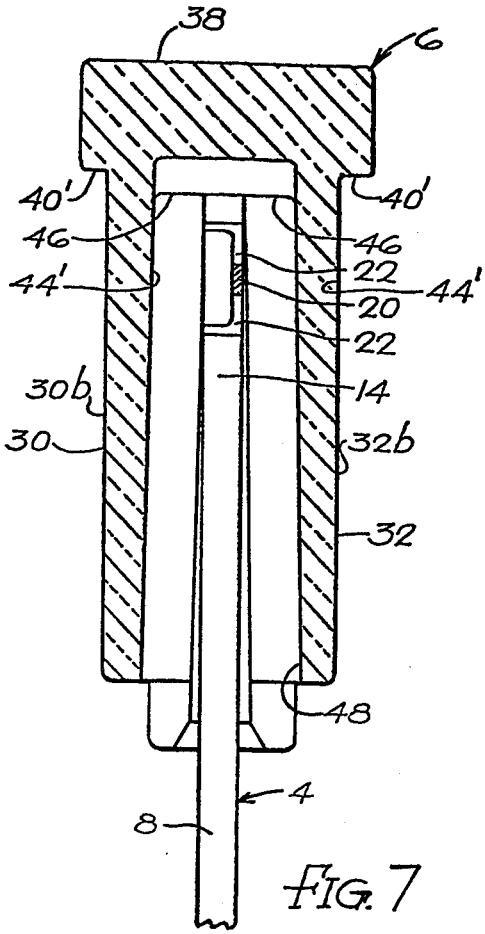
FIG. 7

METHOD OF MAKING A MINIATURE PLUG-IN FUSE

RELATED APPLICATIONS

This application deals with a method which is an improvement over that disclosed in U.S. Pat. No. 3,962,782, for Method of Making a Miniature Plug-In Fuse, and is a continuation-in-part of application Ser. No. 692,040, filed June 2, 1976, which issued as U.S. Pat. No. 4,023,265, and which application, in turn, is a continuation of application Ser. No. 640,253, filed Dec. 12, 1975 now abandoned.

The principal object of this invention is to provide an improved method for making a plug-in fuse assembly preferably like the miniature plug-in fuse disclosed in U.S. Pat. No. 3,909,767, granted September 30, 1975.

BACKGROUND AND SUMMARY OF THE INVENTION

Briefly, this invention has to do with a method of making a plug-in fuse assembly like that disclosed in U.S. Pat. No. 3,909,767, granted Sept. 30, 1975, and which preferably comprises a plug-in element including a plate-like body of fuse metal having a pair of spaced confronting terminal blade portions to be received by pressure clip terminals in a mounting panel, current carrying extensions at the inner end portions of the pair of terminal blade portions and a fuse link portion of reduced thickness interconnecting the current carrying extensions, and an insulating body, preferably a synthetic plastic housing, anchored between the current carrying extensions, with the pair of terminal blade portions thereof extending outwardly from the housing.

The preferred method of making such a plug-in fuse assembly comprises providing a blank of fuse metal which is blanked to form the pair of laterally spaced coplanar terminal blade portions current carrying extensions thereof and the interconnecting fuse link portion of reduced thickness. When the fuse link portion thereof is very fragile, the blanking operation leaves a relatively rigid web between the terminal blade portions formed in the blank.

The synthetic plastic housing is then inserted over said blank of fuse metal so it terminates short of the transverse web and the blank of fuse metal is suitably secured in the synthetic plastic housing as by staking or other means so that it acts as a rigid insulating body connected between the current-carrying extensions and/or terminal blade portions of the partially enclosed plug-in fuse element. (While less desirable, the housing function for this body of insulation material can be eliminated so it acts only as a rigid support and, if desired, a convenient gripping surface for the plug-in fuse element.) Where used, the exposed transverse web of fuse metal interconnecting the exposed terminal balde portions of the blank is then blaked or otherwise removed to complete the formation of a housed plug-in fuse element whose exposed pair of terminal blade portions may be inserted into metal sockets or the like of a terminal strip.

For maximum mass production efficiency of the housed plug-in fuse element just described, the blank of fuse metal from which each plug-in fuse element is formed as preferably part of a long strip of fuse metal upon which various blanking operations are performed as the strip moves past various stamping stations. The individual plug-in fuse elements are not completely separated from the strip until just before or after the housing is applied thereto at the end of the strip.

One of the cost saving and size reducing aspects of the preferred method of making plug-in fuses just described is that each plug-in fuse element is a stamping made from a blank or strip of fuse metal, and a completely housed fuse results from merely enclosing the same in an insulating housing, so that the entire fuse assembly is formed of only two parts, and without any soldering operations required to connect a fuse link between the terminal portion of the fuse. The manufacturing costs are reduced to a minimum when various blanks form interconnected portions of a strip of fuse metal so that the strip acts as a carrier for the blanks as they are successively moved past stamping dies which carry out the blanking operations just described.

As disclosed in the aforementioned U.S. Pat. No. 3,909,767 and in the method of the aforementioned U.S. Pat. No. 3,962,782, the reduced thickness of the interconnecting fuse link portion is provided by initially milling and squeezing the blank of fuse metal only at a point in the blank where the interconnecting fuse-forming link portion is formed by the subsequent blanking operation. This requires a separate milling and squeezing operation at a precise point in each blank of fuse metal. With this procedure it is extremely difficult to maintain sufficiently accurate tolerances for the reduced thickness of the fuse-forming link portion of the plug-in element, and this is compounded where the blanks form integral parts of a continuous intermittently advanced strip of fuse metal, wherein deviations in reduced thickness can also occur from blank to blank, all of which is detrimental to mass porduction of plug-in fuse assemblies having accurate fuse ratings. In addition to this problem of maintaining tolerances and accurate fuse ratings there is also the problem of time consumption and cost in such procedure.

In the method of the instant invention, the aforesaid milling and squeezing operation at precise points in each blank and the aforementioned problems involved therewith are eliminated. In the method of this invention, the blank of fuse metal is initially provided with a continuous portion of reduced thickness extending between opposite margins thereof so that, when the blank is blanked, the interconnecting fuse-forming link portion of the blank is of less thickness than the spaced coplanar terminal blade portions and the current carrying extensions. Preferably, a continuous strip of fuse metal is utilized which is initially longitudinally provided throughout its length with a continuous longitudinal hard portion of reduced thickness. This band of reduced thickness in the blank or strip most advantageously passes through the center thereof so that by blanking the reduced thickness portion of the blank or strip there is left on opposite sides thereof said terminal blade portions and current-carrying extensions. (However, in accordance with the broadest aspects of the method invention disclosed in said patents, in the form of the invention where blanks are interconnected in a strip, the blanking operation may be carried out so that the terminal blade portions and current carrying extensions are oriented transversely rather than longitudinally of the strip and are formed on the same side of the band of reduced thickness, in which event the band of reduced thickness could extend along one margin of the strip or off-centered thereon.) The assembly of a housing on the strip is probably made easier by the method where the band of reduced thickness extends centrally of the strip and is blanked so that the terminal blade portions and their extensions are oriented longitudinally of the strip because a housing having an entry opening at one end can be readily slipped over an exposed longitudinally facing end of an end blank of the strip, either before or after it is reversed therefrom, to encompass the portion of the blank other than the terminal blade portion thereof which are to project from the housing. Also, when the band of reduced thickness is located within the longitudinal margins rather than along one margin of the strip or blank, the ends of the current carrying extensions formed from each blank are, like the terminal blade portions thereof, formed by the thicker portions of the blank where they can more readily withstand the pressure of testing probes without damage thereto.

The continuous portion of reduced thickness is preferably provided in the blank or continuous strip of fuse metal by controlled conventional continuous milling and scarfing procedures, whereby the tolerance of the portion of reduced thickness is kept within close limits. As a result, the thickness of the fuse-forming link portions of reduced thickness subsequently blanked from each blank is maintained within close tolerances, not only in each plug-in fuse element, but, also, from plug-in fuse element to plug-in fuse element blanked from the blank or continuous strip.

The portions of reduced thickness of the strip or blank of fuse metal may be formed by milling and scarfing both sides thereof or by milling and scarfing only one side thereof. The strip or blank of fuse metal may also be plated, such as tin plated, to provide improved electrical contact of the coplanar terminal forming blade portions of the ultimate plug-in element with the pressure clip terminals in the mounting panel in which they are received.

Other features and advantages of this invention will become apparent to those skilled in the art upon reference to the accompanying specification, claims and drawings.

DESCRIPTION OF THE DRAWINGS

FIG. 5 is an enlarged bottom view of the plug-in fuse assembly of FIG. 1;

FIG. 6 is an enlarged transverse vertical sectional view through the plug-in fuse assembly in FIG. 4, taken along section line 6—6 thereof;

FIG. 7 is an enlarged vertical transverse sectional view through the center portion of the plug-in fuse assembly shown in FIG. 4, taken along section line 7—7 thereof;

DESCRIPTION OF THE PREFERRED EMBODIMENT OF THE INVENTION

Referring now more particularly to FIGS. 1–4, there is shown a plug-in fuse assembly 2 made of only two component parts, namely a plug-in fuse element 4 which most advantageously is a single stamping from a strip of fuse metal, and a housing 6 which most advantageously is a single piece synthetic plastic molded part defining a space therein into which portions of the plug-in fuse element 4 extend and are secured in any suitable way, but most preferably by a cold staking an ultrasonic welding operation.

Figure 1:
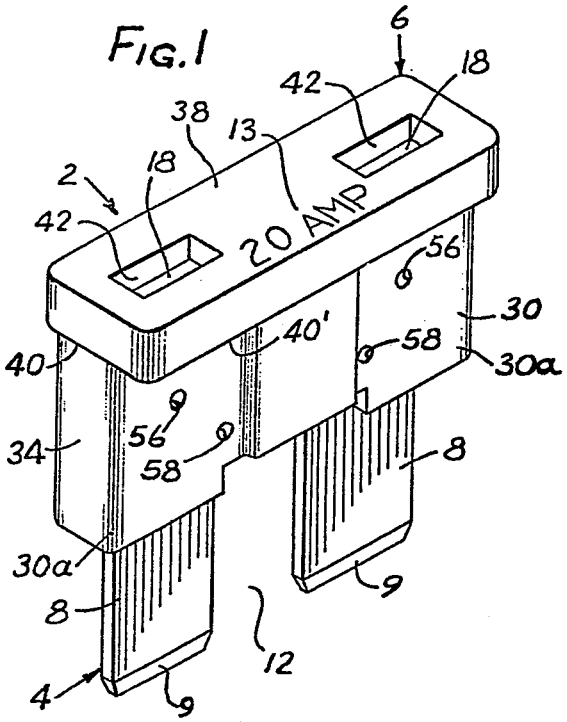
FIG. 1 is a perspective view of a preferred from of the plug-in fuse assembly of the invention.
Figure 2:
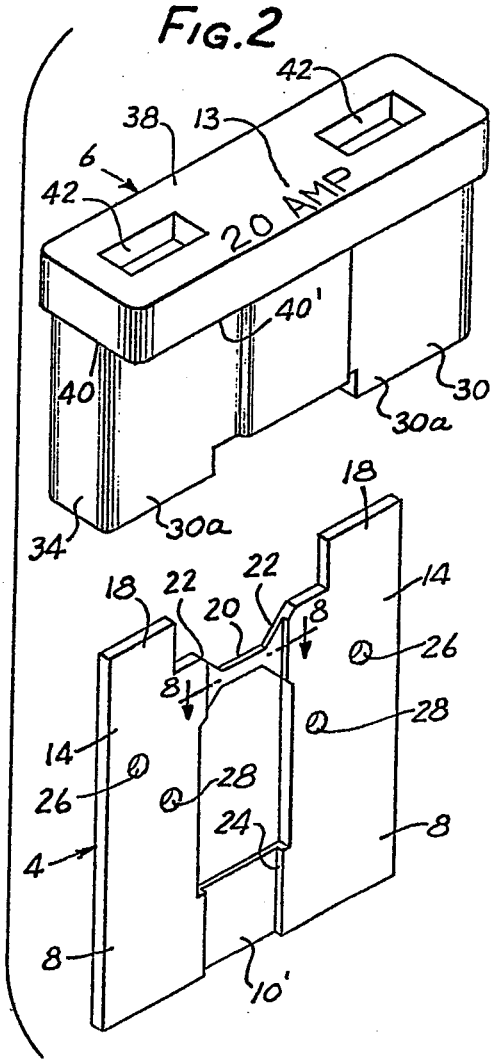
FIG. 2 is an exploded view of the housing and plug-in fuse element for making up the plug-in fuse assembly of FIG. 1.
Figure 3:
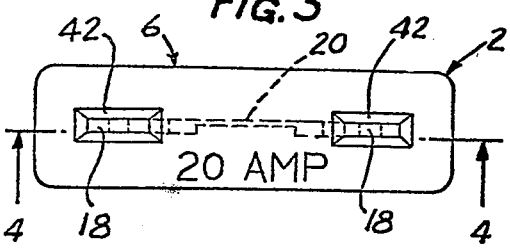
FIG. 3 is a top plan view of the plug-in fuse assembly of FIG. 1.
Figure 4:
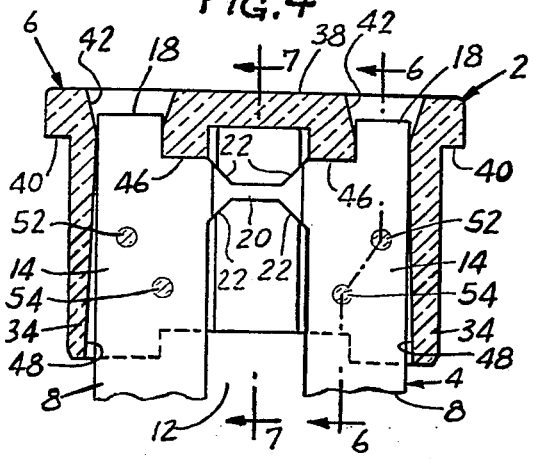
FIG. 4 is a vertical longitudinal sectional view through the plug-in fuse assembly shown in FIG. 3, taken along section line 4—4 therein.

The plug-in fuse element 4 has terminal blade portions 8—8 plated with a highly conductive metal like tin extending in spaced parallel relationship from the inner or bottom margin of the housing 6 in what will be referred to as a downward or inwardly extending direction. The ends of the terminal blade portions 8—8 of the plug-in fuse element, which are spaced apart as indicated at 12, are most advantageously tapered at 9—9 to form pointed end portions which readily slip into place between the confronting walls of conventional spring clip terminals (not shown) supported in mounting panel sockets. The current rating of the plug-in fuse assembly is indicated by indicia 13 on the outer wall of the housing as shown in FIGS. 1–2 and/or by a distinctive housing color.

The plug-in fuse element 4 may be formed from a partially tin plated strip 4′ of fuse metal. Prior to the plug-in fuse element being severed from the strip 4′, the terminal blade portions 8—8 may be interconnected to form a transverse rigidifying web 10′ stamped from a reduced portion of the strip. The stamping operation also forms the terminal blade portions 8—8 defined by a gap 12 between the same. The tapered portions 9—9 of the terminal blade portions 8—8 may be formed by coining dies (not shown) preferably after the operation which severs the plug-in fuse element from the strip.

The terminal blade portions 8—8 have current-carrying extensions 14—14 which are preferably tin plated at least at the outer end portions thereof where, continuity checking probe-receiving tabs 18—18 are formed. The current-carrying extensions project into the aforementioned space formed by the housing 6 where they are contiguous to the front or outer wall of the housing to be described. The current-carrying extensions 14—14 are interconnected by an unplated fuse link portion 20 which is preferably both narrower in width and much smaller in thickness than the other current-carrying portions of the plug-in fuse element 4. The current-carrying capacity of the fuse link portion 20 may be varied by varying its thickness and its width dimensions. In the particular configurations of the plug-in fuse element 4 shown in FIGS. 2 and 4 the current-carrying extensions 14—14 joint the fuse-forming link portion 20 of the plug-in fuse element 4 by tapered portions 22—22. All of the various parts of the plug-in fuse element are shown substantially in co-planar relation.

Figure 9:
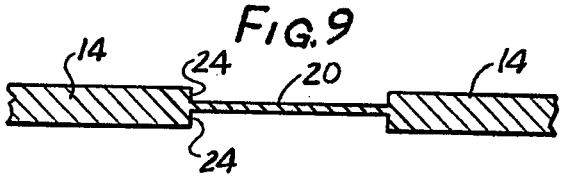
FIG. 9 is a view similar to FIG. 8 showing a different manner in which the fuse-forming link portion is reduced in thickness.
Figure 8:
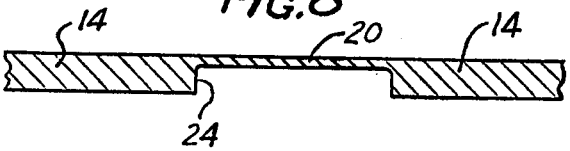
FIG. 8 is a greatly enlarged fragmentary sectional view through the fuse link portion of the plug-in fuse assembly shown in FIG. 2, taken along section line 8—8 of FIGS. 2 and 10, and showing the preferred manner in which the fuse-forming link portion thereof is reduced in thickness.
Figure 10:
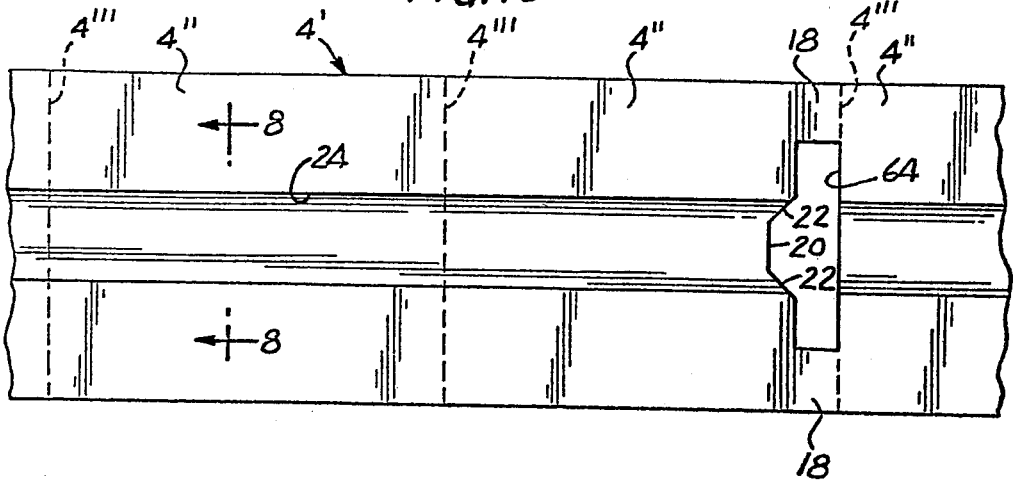
FIG. 10 is a side view of the strip of fuse metal having the elongated central portion of reduced thickness from which the plug-in fuse elements are blanked, and also showing a first blanking step if such step is desired.

The reduction of the thickness of the fuse element of the fuse-forming link portion 20 is preferably achieved by initially providing the strip 4' of fuse metal and, hence, the blanks 4'' of the strip with a centrally arranged groove 24 extending longitudinally throughout the strip 4', as shown in FIGS. 8 and 10, to provide a longitudinally extending central portion of reduced thickness in the strip 4' and the blanks 4''. Alternatively, the strip 4' may be provided with a groove 24 on both sides of the strip, as illustrated in FIG. 9, to provide the longitudinally extending central portion of reduced thickness in the strip 4' and the blanks 4'', the central portion of reduced thickness being located substantially midway of the thickness of the strip in FIG. 9, as distinguished from being located at one face of the strip as in FIG. 8. The groove or grooves 24 are preferably formed in the strip 4' by initially milling and scarfing the strip under close control of tolerance in conventional fashion to provide a central portion of reduced thickness in the strip of fuse metal which is maintained within close tolerances.

The fuse ratings of the plug-in fuse assembly may be accurately determined by the composition of the fuse metal in the strip 4' of fuse metal and the thickness of the fuse-forming link portion 20 of reduced thickness without the need for varying the length of the fuse-forming link portion 20 or the width thereof, so that various fuse ratings may be obtained without any change in the blanking dies for forming the plug-in fuse elements. For example, with a fuse-forming link portion 20 having a length of 0.156 inch related to the width of the groove or grooves 24 in the strip 4' of fuse metal and a width of 0.0350–0.0355 inch, and formed from a zinc alloy fuse metal strip 4' of substantially 0.026 inch ± 0.0005 inch in thickness and having the following composition in weight percent, Fe 0.08 max., Cd. 0.07 max., Cu 0.75–1.25, Pb 0.10 max., Mg 0.01 max., and Zn balance, the following fuse ratings in amperes are obtained with the following thicknesses of the reduced thickness fuse forming portion 20:

| Rating in amps | Thickness in " |
|---|---|
| 5 | 0.0020 – 0.0022 |
| 10 | 0.0044 – 0.0046 |
| 15 | 0.0075 – 0.0079 |
| 20 | 0.0110 – 0.0115 |
| 25 | 0.0150 – 0.0155 |
| 30 | 0.0200 – 0.0205 |

Alternatively, as disclosed in copending application Ser. No. 698,079, plug-in fuse elements of different fuse ratings may be obtained from the same strip 4' and varying the configuration and/or location of the fuse links.

While the plug-in fuse element 4 may be used as a fuse element without its incorporation in the housing 6, for safety reasons it is preferred to incorporate the plug-in fuse element 4 in the housing 6. To this end, and for reasons to be explained, the outer end portions of the terminal extensions 14—14 are provided with outwardly or upwardly projecting tabs 18—18 adapted to make contact with test probes to test for the continuity of the fuse-forming link portion 20 of the plug-in fuse element 4. Also, to anchor the plug-in fuse element 4 within the housing 6, anchoring apertures 26—26 and 28—28 are respectively formed in the terminal extensions 14—14 to receive anchoring projections to be described formed in the housing walls.

While the plug-in fuse element 4 of such a high rating that the fuse link portion thereof is not fragile may be used as a fuse element without its incorporation in a housing or attachment to another body of insulating material acting only as a support structure for the terminal blade portions of the fuse element, for safety and other reasons it is preferred to incorporate the plug-in fuse element 4 in the housing 6. To this end, and to anchor the plug-in fuse element 4 within the housing 6, anchoring apertures 26—26 are formed in the terminal extensions 14—14 to receive anchoring projections to be described formed in the housing walls.

While the housing 6 could be made in two separate parts snappable or otherwise secured together, the housing is most advantageously a single piece molded part as previously indicated. Also, it preferably has a narrow elongated configuration formed by relatively closely spaced walls generally indicated by reference numeral 30–32, the side walls having end portions **30*a*–32*a* which are spaced together much more closely than the central or intermediate portions 30*b*–32*b* thereof. The side walls 30–32 are interconnected at their end margins by narrow end walls 34—34, and at their outer or top margins by an outer wall 38 which overhangs the rest of the housing to form downwardly facing shoulders 40—40 at the longitudinal ends of the outer wall 38 and downwardly facing shoulders 40'—40' along the longitudinal side margins of the housing 6. The shoulders 40'—40' are coplanar continuations of the shoulders 40—40 at the ends of the housing 6**.

Terminal access openings 42—42 are provided in the outer wall 38 adjacent the opposite end portions thereof in alignment with the location of the test probe-receiving tabs 18—18 of the plug-in fuse element 4. The walls of the terminal access openings 42—42 taper down to an inner dimension which approximates the width of the test probe-receiving tabs 18—18 so that test probes can be guided into contact with the tabs 18—18. The terminal access openings 42—42 communicate with the aforementioned plug-in fuse element receiving space in the housing 4. The portions 44—44 of this space immediately beneath the access openings 42—42 are relatively small because of the close spacing of the side wall portions **30*a*–32*a* of the housing at these points, the width of the space portion 44—44 as viewed in FIG. 6 tapering from the bottom open end of the housing upwardly toward the terminal access openings 42—42, reaching a narrow dimension about equal to the thickness of the plug-in fuse element 4. The space portions 44—44 are provided on opposite sides thereof with small inwardly directed ribs 28 for engaging and centering the upper portions of the plug-in fuse element 4 in the housing 6. At the inner margins of the terminal access openings 42—42 the upper wall 38 is provided with downwardly extending skirts 46—46 which act as shield walls preventing spewing fuse metal from gaining entrance to the terminal access openings 42—42. These shield forming skirts 46—46 also act as stop or abutment shoulders for the current-carrying extensions 14—14 of the terminal-forming blade portions 8—8** of the plug-in fuse element.

The fuse link portion 20 of the fuse element 4 is positioned in a relatively wide portion 44' (FIG. 7) of the housing interior, to provide for free circulation of air around the center portion of the fuse-forming link portion, which is the part thereof which first melts under excessive current flow, so heat does not accumulate which would adversely affect the current at which the fuse will blow.

The narrow and wide portions 44—44 and 44′ of the space within the housing 6 open onto the bottom of the housing for the full extent thereof through an entry opening 48. The opening 48 permits the housing to be pushed over the end portion of end blank of the prestamped and milled strip 4′ from which a completed fuse element is punched and immediately following the housing 6 is secured to the end portion or end blank of the strip as previously indicated.

The housing 6 is preferably a molded part made of a transparent synthetic plastic material so that the fuse-forming filament portion 20 of the plug-in fuse element 4 is readily visible through the intermediate portion of the outer wall 38, to which the fuse-forming link portion 20 is in spaced but relatively contiguous relation. The housing may be molded of a high temperature material sold by Union Carbide under the trademark "POLYSULFONE" and order No. P1700, Natural 11.

While the housing interior could be made with resilient projections which snap into the anchoring apertures or openings 26—26 in the plug-in fuse element 4, it is preferred to secure the housing in place by forming projections 52 from both sides of the housing 6 by a cold staking operation, which enter the anchoring apertures 26—26 of the plug-in fuse element 4. The inwardly extending projections 52 are formed by the cold staking operation where they engage each other in the anchoring apertures or openings 26 are preferably welded together by ultrasonic welding or the like to provide a rigid anchoring structure. The depressions 56 left by the staking operation are shown in the side wall 30 in FIGS. 1 and 6.

The exemplary embodiments of the fuse assemblies described have thus provided exceedingly reliable, compact and inexpensive plug-in fuse assemblies which can be readily inserted into and removed from suitable closely spaced spring clip terminal connectors in a mounting panel by grasping the shoulders 40—40 at the longitudinal ends of the housing 6. The transparent material out of which the housing 6 is made forms a convenient window in the outer wall through which the fuse-forming link portion of the plug-in fuse element can be viewed when the plug-in fuse assembly is mounted on the mounting panel. The terminal access openings enable test equipment to test the continuity of the fuse if the user does not desire to rely solely on a visual observation of the fuse-forming link portion of the fuse.

Figure 11:
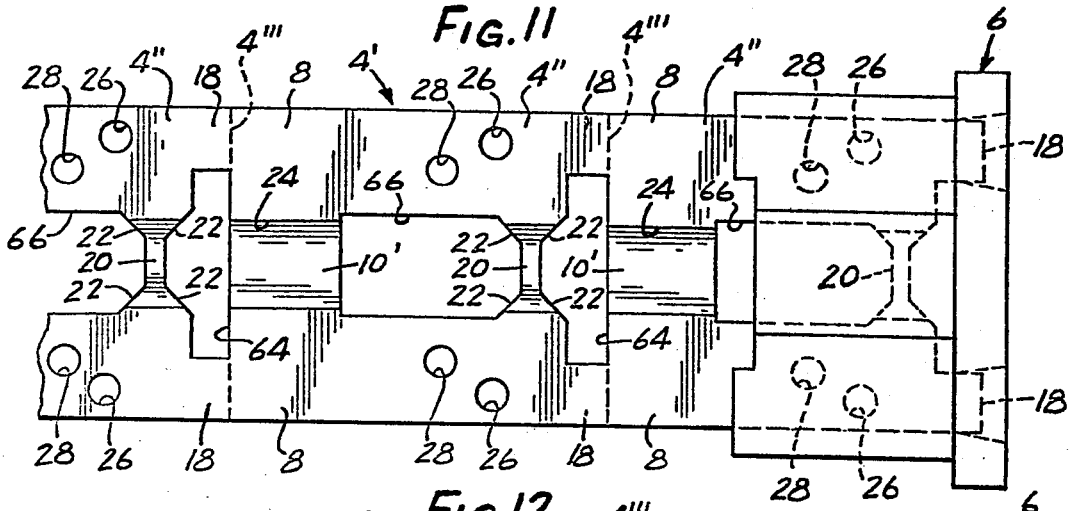
FIG. 11 is a side view of the strip of fuse metal as shown in FIG. 10 but showing the second blanking step to provide the plurality of blanks forming the plug-in fuse elements and the insertion of the housing onto the end blank of the strip.
Figure 12:
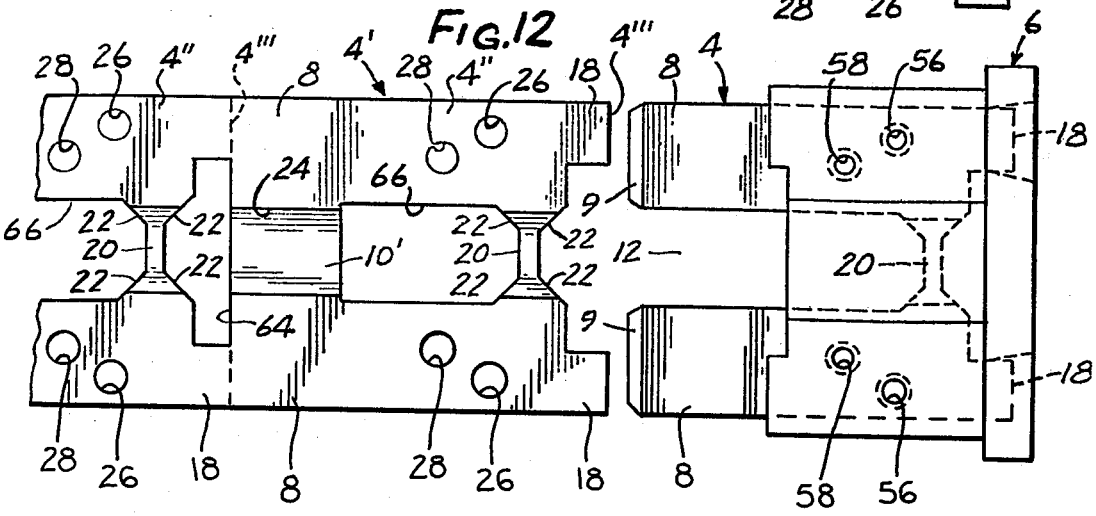
FIG. 12 is a view similar to FIG. 11 showing the separation from the strip of fuse metal the completed plug-in fuse assembly.

The preferred method of making the plug-in fuse assemblies is illustrated in FIGS. 10–12. Before the strip 4′ is grooved, it preferably is a fuse metal body 4A of the same thickness throughout. In accordance with the preferred method of fabricating the strip, the fuse metal strip is initially plated throughout with a conductive coating which does not oxidize in the surrounding air. Where tin is selected as this conductive coating, to prevent bleeding of the fuse metal through the tin coating an initial coating of copper is plated on all exposed surfaces of the ungrooved strip except in a central band on one side of the strip opposite to where the groove 24 in FIG. 8 is to be formed following which tin is similarly plated thereon. For example, the copper plating is preferably between 0.00005 and 0.0001 inch and the tin plating is preferably between 0.00015 and 0.0002 inches thick. These coatings may be applied by electroplating these metals on the surface of the ungrooved strip. The plated strip 4A is formed into the grooved strip 4′ by milling and skiving or otherwise forming the aforementioned groove 24 to a precise depth throughout the length of the strip 4A which removes the previous plating thereon.

The grooved strip of fuse metal is advanced in any desired manner to various stamping dies (not shown). The advancing strip 4′ of fuse metal is blanked to form the terminal blade portions 8, the current-carrying extensions 14 thereof and the further extensions 18 thereof, and the fuse link portion 20 of of reduced thickness. This may be accomplished in one blanking operation or in a plurality of blanking operations. As illustrated herein, the blanking operation is accomplished in two steps. The first blanking step in the sequentially advancing strip 4′ is illustrated in the right hand portion of FIG. 10 wherein each blank 4″ is sequentially blanked as indicated at 64 to provide the extensions 18 and a portion of the fuse link 20 having the tapered portions 22. Thereafter, each blank is sequentially blanked as illustrated in FIG. 11 at 66 to provide the current-carrying extensions 14 and the fuse link portion 20 of reduced thickness extending between the current-carrying extensions 14 and having the tapered portions 22. During this same blanking operation the interlocking holes 26 and 28 are also blanked. In this blanking operation the transverse web 10′ still remains between the terminal forming blade portions 8 of each blank. Because of the groove or grooves 24 extending throughout the length of the strip 4′ of fuse metal, the transverse web 10′ is also of reduced thickness, but is has sufficient rigidity and strength to rigidify the plug-in fuse elements 4 during the processing thereof.

As shown in FIG. 11, the housing 6 is inserted over the end blank 4″ to receive the current-carrying extensions 14 and further extensions 18 thereof and the fuse-forming link portion 20 within the housing and with the terminal forming blade portions 8 still interconnected by the transverse web 10′ extending from the housing. The housing is then cold staked and/or ultrasonically secured in the interlock openings 26 and 28 of the end blank 4″ as indicated at 56, 58 in FIGS. 6 and 12. Preferably, the placing of the housing 6 over the end blank 4″ and securing the housing to the end blank occurs before severing the end blank from the strip at the blank edge 4‴. In FIG. 12 the end blank 4″ and its housing 6 are severed from the strip 4′ at the blank edge 4‴ of the end of the blank 4″ to form the substantially completed plug-in fuse assembly, but with the transverse web 10′ still intact. Thereafter, the transverse web 10′ is blanked at 12 to provide the spaced apart terminal blade portions 8 as indicated in FIG. 12. Thereafter, the ends of the terminal blade portions 8 may be coined as illustrated at 9 to form tapered ends for the terminal blade portions. In this way, the complete plug-in fuse assembly as illustrated in FIGS. 12 and 1 may be provided.

While for purposes of illustration herein one preferred specific method of making the plug-in fuse assembly has been disclosed herein, other methods may become apparent to those skilled in the art upon reference to this disclosure and, therefore, this invention is to be limited only by the scope of the appended claims.

I claim:

1. A method of making a plug-in fuse element comprising a plate-like body of the fuse metal having a pair of terminal blade portions to be received by pressure clip terminals in a mounting panel, current-carrying extensions at the inner end portions of the pair of terminal blade portions and a fuse link portion interconnecting the current-carrying extensions, said method comprising the steps of providing a blank of fuse metal which is initially provided between opposite margins thereof with a continuous band of reduced thickness, blanking said blank of fuse metal including at least said portion of reduced thickness to leave a pair of juxtaposed, spaced, terminal forming blade portions outside of said portion of reduced thickness, said fuse link portion formed in said portion of reduced thickness and said current-carrying extension of said terminal blade portions interconnected by said fuse link portion.

2. The method as defined in claim 1 wherein said continuous band of reduced thickness is reduced by a step including milling.

3. The method of claim 1 wherein the continuous band of reduced thickness of the blank of fuse metal is reduced by a step including decreasing the thickness from both sides of the blank.

4. The method of claim 1 wherein the continuous band of reduced thickness of the blank of fuse metal is reduced by a step including decreasing the thickness from one side only of the blank.

5. The method of claim 1 wherein there is connected between said current-carrying extensions a body of insulation material forming a band grippable surface and a rigid interconnection between said current-carrying extensions.

6. The method of claim 1 wherein said continuous band of reduced thickness extending between said opposite margins of the blank is spaced inwardly of two other opposite margins of the blank so said blanking operation leaves at least the end portions of said current-carrying extensions formed from portions of the blank outside of said band of reduced thickness.

7. The method of claim 1 wherein said blanking operation leaves a web interconnecting said terminal blade portions, said web being of sufficient width to form a rigid interconnection between said terminal blade portions, securing between said current-carrying extensions insulating means forming a rigid interconnection therebetween with the pair of terminal blade portions of the blank, which are interconnected by the web extending outwardly from the insulating means, and blanking the exposed web of fuse metal interconnecting the terminal blade portions to complete the formation of the plug-in fuse assembly.

8. The method of claim 1 wherein a plurality of said plug-in fuse elements are made in a mass production operation comprising the steps of providing a continuous strip of fuse metal constituting a plurality of longitudinally spaced interconnected blank portions from each of which is to be formed said plug-in fuse element, said strip being provided throughout its length with a continuous portion of reduced thickness forming said continuous band of reduced thickness in each blank, sequentially advancing the continuous strip of fuse metal, blanking said continuous strip of fuse metal to provide in each of said blanks of the strip said pair of spaced terminal blade portions and current-carrying extension thereof and a fuse link portion interconnecting said current-carrying extensions thereof, and severing plug-in fuse elements from the end of the sequentially advanced strip of fuse metal.

9. The method of claim 8 wherein said blanking operation also forms for each longitudinally interconnected blank a web extending between said terminal forming blade portions, which web is of sufficient width to form a rigid interconnection between said terminal forming blade portions, securing between said current-carrying extensions of each end blank of the strip insulating means forming a rigid interconnection therebetween, with said terminal forming blade portions and web located externally of said insulating means, and blanking the exposed web of each end blank after application of said insulating means.

10. The method as defined in claim 8 wherein the continuous portion of reduced thickness throughout the length of the strip of fuse metal is reduced by a step including milling.

11. The method as defined in claim 8 wherein the continuous portion of reduced thickness throughout the length of the strip of fuse metal is reduced by a step including decreasing the thickness from both sides of the strip.

12. The method of claim 8 wherein the continuous portion of reduced thickness throughout the length of the strip of fuse metal is reduced by a step including decreasing the thickness from one side only of the strip.

* * * * *

UNITED STATES PATENT AND TRADEMARK OFFICE

Certificate

Patent No. 4,099,321 Patented July 11, 1978

On petition requesting issuance of a certificate for correction of inventorship pursuant to 35 USC 256, it has been found that the above-identified patent, through error and without any deceptive intent, improperly sets-forth the inventorship. Accordingly, it is hereby certified that the correct inventorship of this patent is Avinash P. Aryamane and Allen L. Ciesmier.

Signed and Sealed this 3rd Day of February, 1987.

BRADLEY R. GARRIS,
*Office of the Deputy Assistant Commissioner for Patents.*